United States Patent [19]

Folgerö et al.

[11] 3,971,548

[45] July 27, 1976

[54] METALLURGICAL FURNACE HAVING A BLAST INJECTION NOZZLE

[75] Inventors: Kåre Folgerö, Vasteras; Lars-Gunnar Norberg, Hagfors; Karl-Erik Öberg, Borlange, all of Sweden

[73] Assignee: Allmanna Svenska Elektriska Aktiebolaget, Vasteras, Sweden

[22] Filed: Mar. 20, 1975

[21] Appl. No.: 560,204

[30] Foreign Application Priority Data

Mar. 20, 1974 Sweden ..... 7403730

[52] U.S. Cl. ..... 266/218; 266/265

[51] Int. Cl.[2] ..... C21C 5/48

[58] Field of Search ..... 110/182.5; 122/6.6; 75/59, 60; 266/34 PP, 35, 36 P, 41

[56] References Cited

UNITED STATES PATENTS

| | | | |
|---|---|---|---|
| 2,333,654 | 11/1943 | Lellep | 266/41 |
| 3,330,645 | 7/1967 | De Moustier et al. | 75/60 |
| 3,794,308 | 2/1974 | Ponghis et al. | 266/41 |
| 3,873,074 | 3/1975 | Chang | 266/41 |

FOREIGN PATENTS OR APPLICATIONS

| | | | |
|---|---|---|---|
| 64,977 | 12/1955 | France | 266/41 |
| 5,380 | 1883 | United Kingdom | 266/41 |

*Primary Examiner*—Gerald A. Dost
*Attorney, Agent, or Firm*—Kenyon & Kenyon Reilly Carr & Chapin

[57] ABSTRACT

A metallurgical furnace has a wall contacted by molten metal and having a nozzle opening below the level of the metal, a nozzle positioned in this opening forms a passage for injecting a blast into the metal, and this nozzle has means for liquid-cooling the outer end of its blast passage to freeze the molten metal when flowing backwardly through the nozzle's passage in the event of a blast failure. In such an event, the frozen or solidified metal forms a stopper for the nozzle's passage.

5 Claims, 5 Drawing Figures

METALLURGICAL FURNACE HAVING A BLAST INJECTION NOZZLE

BACKGROUND OF THE INVENTION

A recently developed metallurgical furnace intended for finishing a semi-finished steel melt, has a contour generally resembling a Bessemer convertor and, like that convertor, is made so that it can be tilted between the vertical and horizontal positions. However, it is intended for finishing operations requiring the addition of heat while the melt is being dephosphorized or the like, as contrasted to the Bessemer convertor's function of converting blast-furnace iron to steel.

For the addition of heat, the bottom of this furnace is provided with a channel-type electric inductor extending diagonally so that when the furnace is vertical, the inductor can add heat to the melt, and when the furnace is horizontal, the inductor channel can retain sump metal, the side of the furnace that is downward when the furnace is horizontal, having a tap hole that can be opened for tapping the melt after its finishing.

For the introduction of dephosphorizing agents, alloys, or whatever is required to finish the melt in the furnace, a blast nozzle extends through the bottom of the furnace and through which the finishing materials, in particulate form, are blasted into the melt, being carried by a pressurized gas, normally a gas that is inert relative to the melt.

In operation, this recently developed furnace is vertically positioned to receive the melt from the primary melter, which may be an electric arc furnace, for example. To prevent the melt from flowing backwardly through the nozzle, the latter is supplied with a blast of the inert gas, thus holding up the melt from entering the nozzle during the charging. During the finishing operation, the blast is supplied with the finishing or alloying materials and, when finished, the furnace is turned to its horizontal position for tapping, the blast nozzle being positioned so that at that time it is above the level of the melt, although for various reasons the nozzle may continue to be supplied with pressurized gas.

With the furnace in its vertical position and receiving the charge of molten metal, and during the finishing period, any failure of the blast, a possibility due to human error, broken blast connections, power failure, etc., leaves the melt free to run backwardly through the nozzle and escape from the furnace. Such a melt-escape presents a serious hazard to the furnace operating personnel, and, of course, to the equipment surrounding the furnace.

During the charging and refining phases, the nozzle is directly exposed to the thermal and erosive effects of the melt and, therefore, it is desirable that the nozzle be made so that it can be removed easily either for servicing or for replacement by a corresponding nozzle. The furnace vessel is, of course, made with a refractory lining surrounded by a metal shell, both having an opening for the nozzle, and the furnace lining should not be damaged during removal and replacement of the nozzle. The outer end of the nozzle can have a metal flange that is removably bolted or otherwise fastened to the metal shell.

Under the obviously severe operating conditions of the nozzle when in use, there is a risk that the nozzle might sinter to the furnace lining and thus become stuck together. It follows that removal and replacement of the nozzle presents a second problem in addition to the first problem of the possibility of a metal break-out.

SUMMARY OF THE INVENTION

The object of the present invention is particularly to cope with the above-described problems, in the case of the described recently developed furnace, recognizing that in doing so, constructional features may become involved that are applicable to any metallurgical furnace requiring the injection of a blast into a melt contained by the furnace.

According to this invention, a nozzle is provided with means for liquid-cooling the outer end of the blast passage through the nozzle, to freeze the molten metal in the event it flows backwardly through the passage because of a blast failure. The blast passage through the nozzle is formed by a metal pipe and to augment the melt-freezing action, the outer end of the pipe is surrounded by a relatively massive plug of metal of high-thermal conductivity, such as copper, this plug being in direct metal-to-metal contact with a metal flange which contains liquid-cooling passages and forms the referred-to liquid-cooling means. In the event of a blast failure, the escaping hot melt reaching the outer end of the nozzle passage, loses heat very rapidly to the plug which is, in turn, rapidly cooled by the cooling liquid flowing through the flange. Normally the liquid would be water and by this indirect transfer of heat to the water, there is little chance for the water to convert to steam while, at the same time, the high-conductivity plug is prevented from approaching the temperature of the escaping melt. Thus, at the outlet end of the nozzle passage, the melting is frozen into solid metal so that the passage is safely plugged.

The nozzle opening through the furnace lining is made inwardly conical and the nozzle itself is correspondingly shaped, and from its outer portion inwardly throughout a substantial extent of its length, the nozzle is formed by a conical metal shell internally packed with a refractory and secured on its outer end to the previously referred to liquid-cooled flange. A major portion of this metal shell fits into a liquid-cooled seat for the shell having on its outer end a metal flange which can be bolted to the metal shell of the furnace vessel, the previously referred to liquid-cooled flange of the nozzle itself, being bolted to the outside of this second flange. All separable metal-to-metal surfaces are liquid-cooled so that the heat to which they are subjected inherently, is largely reduced at these surfaces. Thus, the parts can be separated when required.

BRIEF DESCRIPTION OF THE DRAWINGS

The presently preferred mode for carrying out the invention is illustrated by the accompanying drawings, in which.

DETAILED DESCRIPTION OF THE INVENTION

Figures 1, 1A, 2:
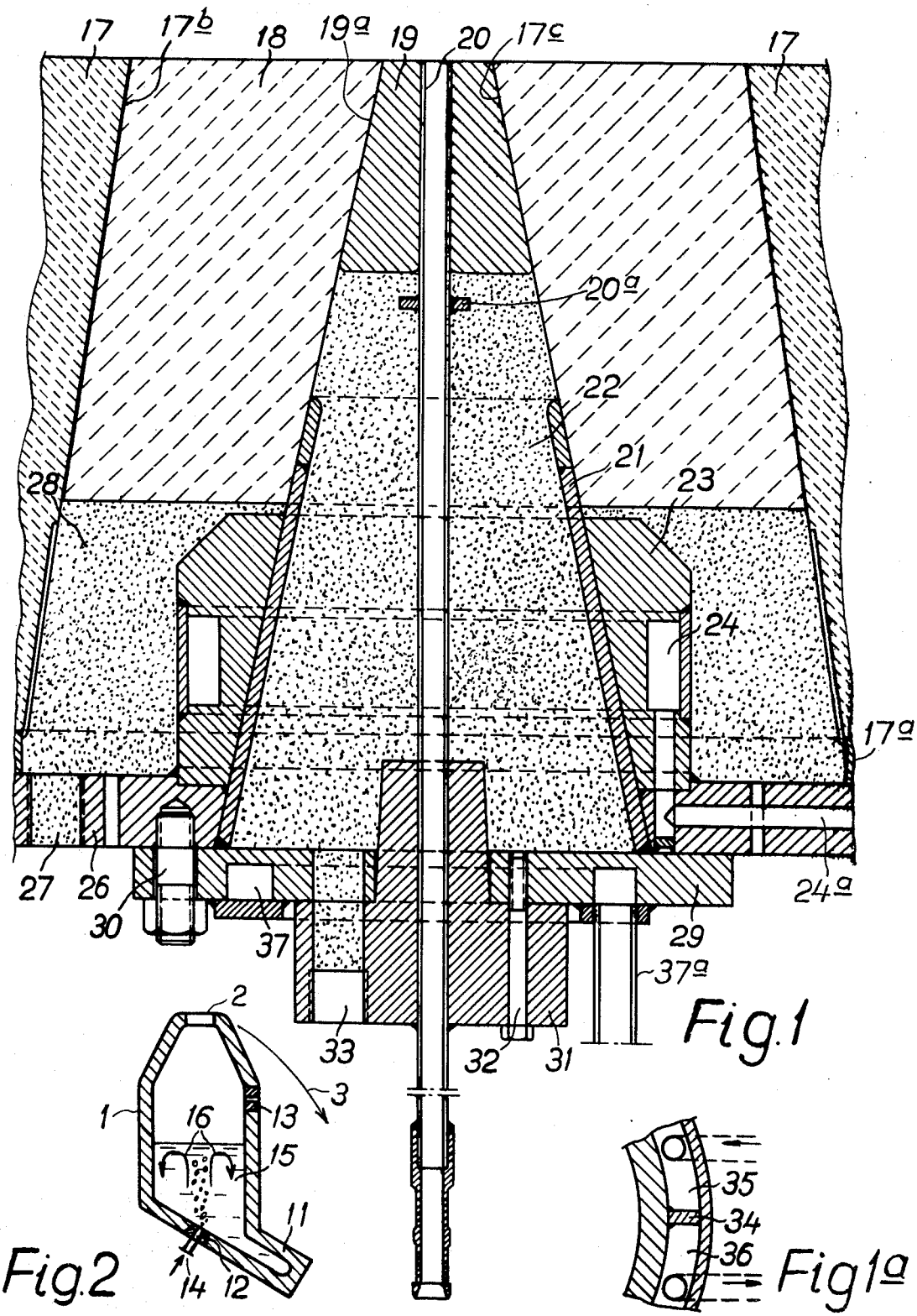
FIG. 1 is a vertical section through the furnace wall and the nozzle which is shown in its operative position.
FIG. 1*a* is a cross section showing a detail in FIG. 1.
FIG. 2 is a vertical section schematically showing the previously referred to recently developed furnace with which the nozzle is used.

Referring first to FIG. 2, the previously referred to furnace is shown with its Bessemer-like vessel shape 1 having a charging opening 2 in its top and through which gases can be exhausted during the refining operation, the furnace bottom having the diagonally extending channel-type electric inductor 11 and nozzle 12, and also the tapping hole 13, the furnace tilting in the direction of the arrow 3 and the last previously referred to, being injected as indicated by the arrow 14 into the melt 15, the effect of the blast and injected particles of refining or alloying or other material producing a circulation as indicated by the arrows 16, assuring a rapid finishing operation. It can be seen that while the furnace is upright, the injected blast 14 must hold the melt 15 against flowing backwardly or downwardly through the nozzle and that if this blast fails for any reason, a melt break-out can occur. With the nozzle exposed to the heat transmitted to it from the melt 15 through the furnace lining, it can be seen that the nozzle operates under conditions presenting the previously referred to problem concerning nozzle removability.

Incidentally, any furnace using the new nozzle may, of course, use more than one of the nozzles. Also, other types of furnaces may present similar problems concerning the use of a blast nozzle. In addition to the heat involved, the nozzle must internally carry, via a highly-pressurized gas carrier, solid particles such as particulated limestone, metallic alloys, and the like, so the nozzle is internally subjected to erosive or abrasive conditions.

The new nozzle itself is shown in FIGS. 1 and 1*a*. The furnace lining is shown at 17 and a small portion of its outer metal shell is shown at 17*a*, the nozzle hole 17*b* formed in the lining 17, being inwardly conical. Although the nozzle can be inserted directly into a conical hole formed in the furnace lining, it is preferable to use on the melt side, a nozzle stone 18 made as a refractory brick or from a sintered refractory compound, but in any event, providing an inner conical seat 17*c*, the inner end of the nozzle being formed by blast stone 19, which may also be made as a refractory brick or from a sintered refractory compound, this blast stone 19 having an external surface 19*a* which forms a precision fit with the conical seat 17*c*. The metal pipe 20 through which the blast is introduced, extends through this part 19 and downwardly and to the outside of the furnace. A conical steel shell 21 surrounds a major part of the length of this pipe 20, its conical shape following the conical angularity of the conical surfaces 17*c* and 19*a*, this shell 21 preferably being made from steel plate and extending from adjacent to the blast stone 19 to the outside of the furnace wall. The conical space inside of this shell 21 and inside of the outer blast stone 18 and up to the inner blast stone 19, is filled with one of the fluent refractory compounds comprising $Al_2O_3$ or MgO, and such as are available on the open market. This compound 22 may be filled in wet or dry, and if wet, the heat of the melt being relied upon for drying.

The conical shell 21 is removably seated within a relatively massive annulus 23 which is internally conically shaped to coincide with the shape of the shell 21, and which is provided with an annular water-cooling passage 24, the outer end of this annulus 23 being fixed to a flange 26 which can be bolted directly to the metal casing or shell 17*a* of the furnace wall, although the fastenings are not shown. This flange 26 is formed with one or more holes 27 through which the previously described type of refractory compound can be forced to be, in effect, injection-molded around the annulus 23 within the outer end portion of the conical hole 17*b* formed through the furnace refractory lining 17. The outer end of the conical shell 21 is fixed to a flange 29 that is, in its turn, bolted by a series of bolts 30 to the flange 26, this nozzle flange 29 receiving the copper high-thermal conductivity plug 31 which surrounds and is in contact with the end portion of the metal pipe 20, this plug being massive and held tightly against the nozzle flange 29 by a series of bolts 32. This plug 31 and the nozzle flange 29 have one or more mutually registered holes 33 extending to the inside of the conical shell 21 and through which the compound 22 can be forced or injected to fill the conical space as previously described. The nozzle flange 29 has the water-cooling passage 37 for cooling the flange 29 and for carrying the heat away from the copper plug 31 which is in direct contact with the flange 29.

A liquid coolant, normally water, can be circulated through the space 24 by way of ducts 24*a* and through the space 37 by way of ducts 37*a*. FIG. 1a serves to show that in either instance the annular spaces involved are provided, in each instance, with a divider 34, water being introduced to the space 35 on one side of this divider and discharged from the space on the other side of the divider 34, thus effecting an annular circulation of the parts involved.

In the event of a blast failure, the molten metal on the inside of the lining 17 will flow downwardly through the pipe 20 but when it reaches the portion of this metal pipe in direct metallic contact with the copper plug 31, the melt will be quickly frozen or solidified, the heat imparted to the plug 31 being rapidly abstracted by its metallic contact with the water-cooled flange 29.

To remove the nozzle, the parts 18 and 19 and the portion of the refractory 22 contacting the outer blast stone 18, have little tendency to stick together because they are all made of refractory material. The metal pipe 20 may be anchored to the upper portion of the refractory material 22 by a metal flange 20*a*. The metal-to-metal surfaces between 21 and 23 and between 29 and 26, all receive the benefits of the water-cooling so they do not tend to weld or sinter together under the heat involved.

Therefore, release of the bolts 30 permits the inner stone 19, the refractory 22 and its shell 21 and the flange 29, together, of course, with the copper plug 31, to be all removed together as a unit, the outer blast stone 18 remaining in position. The copper plug 31 may be individually removed from the nozzle flange 29 or, if desired, brazed to this flange to provide for better thermal conductivity. The annulus 23 and the refractory compound 28 can remain in position during the nozzle removal. Nozzle replacement, of course, is in the reverse order, the refractory compound 22 being renewed if necessary, by injection through the hole or holes 33.

Figure 3:
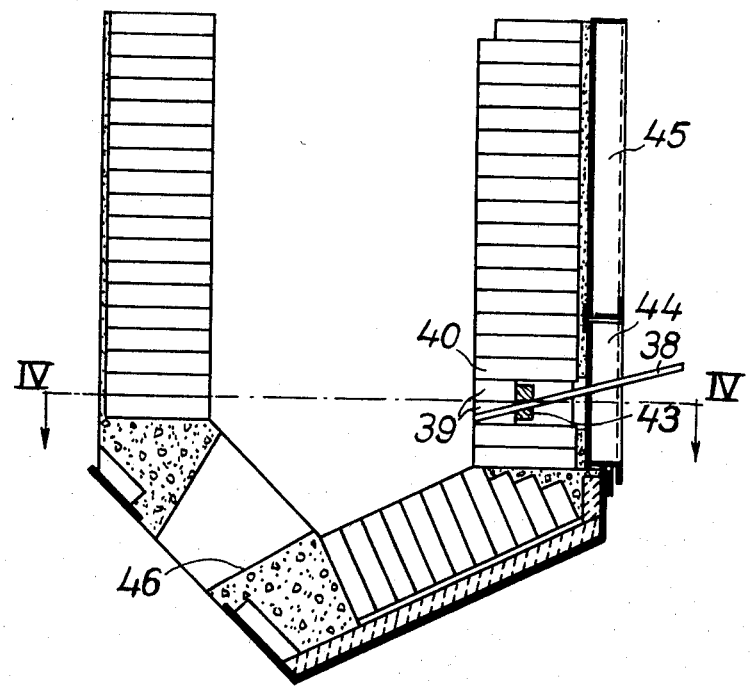
FIG. 3 shows the bottom portion of that furnace in modified form and with a modified form of the nozzle in place.
Figure 4:
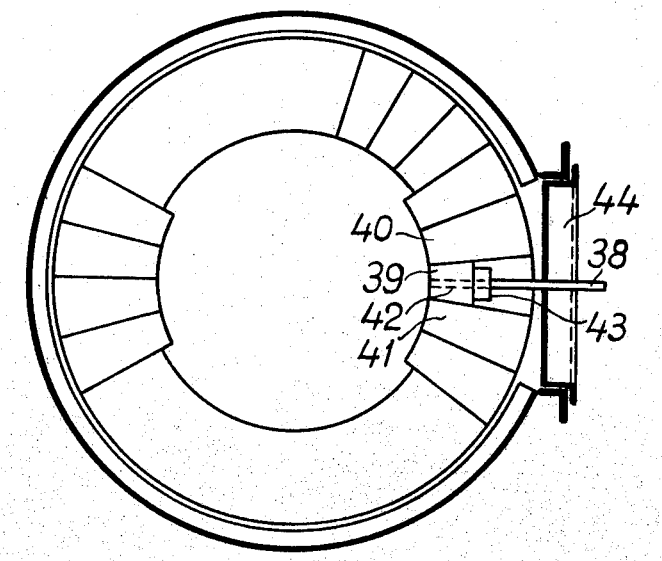
FIG. 4 is a cross section taken on the line IV—IV in FIG. 3.

In the embodiment shown by FIGS. 3 and 4, the feed tube or pipe 38 is fitted between two cut-off standard bricks 39 between two longer bricks 40 and 41, and which are wedge-shaped to form, in this instance, the blast stone 39, the wedge-shaped shorter bricks forming a feed channel 42 communicating with the pipe 38, this inner portion of the feed passage being of refractory material. At the rear part of the shorter brick 39, a massive metallic body 43 is positioned, preferably liquid-cooled also, although not shown, and, of course, having a suitable hole into which the metal feed pipe 38 is inserted in metal-to-metal contact. The nozzle or feed pipe 38 may be mounted by a removable end piece 44 which may be water-cooled as is the portion of the furnace shell 45 which becomes the top when the furnace is tilted to the left as seen in FIG. 3. The opening to which the channel-type inductor is applied, is shown at 46.

What is claimed is:

1. A metallurgical furnace having a wall with an inside contacted by molten metal, the wall having a nozzle opening, and a nozzle in said opening and forming a passage for injecting a blast into said metal, said nozzle having means for liquid-cooling the outer end of said passage to freeze said metal when flowing backwardly through the passage in the event of a blast failure, said nozzle opening and nozzle being conical and the nozzle being removable from the opening, the nozzle comprising a metal conical shell having an outer flange for connection with the outside of the vessel's said wall, said flange having an opening into said shell and through which a fluent refractory material can be injection molded into the shell, a pipe extending longitudinally through the shell and flange forming a blast passage.

2. The furnace of claim 1 in which said means for liquid-cooling is formed by said flange being formed of metal and with a liquid-flow internal passage.

3. The furnace of claim 2 in which a plug of high thermal conductivity metal is fixed in said flange around said pipe.

4. The furnace of claim 3 in which said nozzle opening includes a liquid-cooled jacket surrounding said conical metal shell of the nozzle and from which the shell is removable.

5. The furnace of claim 4 in which the inner portion of said opening is formed by a blast stone fixed to said wall of the vessel, and a metal flange fixed to the outside of said wall and to which said jacket is fixed, has a hole through which a fluent refractory material can be injection molded around said conical shell and jacket to form the outer portion of said opening.

* * * * *